US011655078B2

(12) United States Patent
Fernández De Mendiola Quintana et al.

(10) Patent No.: US 11,655,078 B2
(45) Date of Patent: May 23, 2023

(54) TUBULAR CONTAINER COMPRISING AN OUTER TUBE AND AN INNER CONTAINER

(71) Applicant: CTL-TH PACKAGING S.L., Miñano (ES)

(72) Inventors: Javier Fernández De Mendiola Quintana, Vitoria (ES); Juan Ignacio Valpuesta Landa, Vitoria (ES)

(73) Assignee: CTL-TH PACKAGING S.L., Miñano (ES)

( * ) Notice: Subject to any disclaimer, the term of this patent is extended or adjusted under 35 U.S.C. 154(b) by 52 days.

(21) Appl. No.: 17/606,398

(22) PCT Filed: Apr. 1, 2020

(86) PCT No.: PCT/ES2020/070216
§ 371 (c)(1),
(2) Date: Oct. 25, 2021

(87) PCT Pub. No.: WO2020/216973
PCT Pub. Date: Oct. 29, 2020

(65) Prior Publication Data

US 2022/0194667 A1 Jun. 23, 2022

(30) Foreign Application Priority Data

Apr. 24, 2019 (EP) ..... 19382310

(51) Int. Cl.
*B65D 35/14* (2006.01)
*B65D 35/28* (2006.01)
*B65D 83/00* (2006.01)

(52) U.S. Cl.
CPC ..... *B65D 35/14* (2013.01); *B65D 35/28* (2013.01); *B65D 83/0055* (2013.01)

(58) Field of Classification Search
CPC ..... B65D 35/14; B65D 35/28; B65D 83/005
(Continued)

(56) References Cited

U.S. PATENT DOCUMENTS 5,454,486 A * 10/1995 Mack ..... B05B 11/047 222/105
5,813,571 A * 9/1998 Gaucher ..... B05B 11/026 222/105

(Continued)

FOREIGN PATENT DOCUMENTS

DE 102017121333 A1 3/2019
FR 2721592 A1 12/1995

(Continued)

*Primary Examiner* — Lien M Ngo
(74) *Attorney, Agent, or Firm* — Browdy and Neimark, PLLC

(57) ABSTRACT

Airless tubular container (1) with an outer tube (1*a*) and an inner container (1*b*) both provided with respective skirts (2*a*, 2*b*). The inner container (1*b*) comprises an adapter (3*b*) to couple the inner container (1*b*) to the outer tube (1*a*). The skirt (2*b*) of the inner container (1*b*) is joined to the adapter (3*b*) and comprises a deployable portion (20) arranged under the adapter (3*b*). The deployable portion (20) enables the length of the skirt (2*b*) of the inner container (1*b*) to be adjusted with respect to the length of the skirt (2*a*) of the outer tube (1*a*), during the manufacture of the tubular container (1). Furthermore, the deployable portion (20) allows a relaxed collapsing of the inner container (1*b*) during use of the tubular container (1).

29 Claims, 9 Drawing Sheets

(58) Field of Classification Search
USPC ..... 222/495, 105, 231.7, 231.9, 94; 215/6
See application file for complete search history.

(56) References Cited

U.S. PATENT DOCUMENTS

| | | | | |
|---|---|---|---|---|
| 8,875,425 | B2 * | 11/2014 | Moretti | B05B 11/0038 40/310 |
| 9,290,280 | B2 * | 3/2016 | Moretti | B29C 63/26 |
| 10,071,850 | B2 * | 9/2018 | Sugawara | B65D 83/42 |
| 10,087,062 | B2 * | 10/2018 | Witte | B65D 33/14 |
| 2006/0037968 | A1 * | 2/2006 | Brenner | B65D 83/0055 222/105 |
| 2008/0041890 | A1 * | 2/2008 | Masuda | B65D 35/14 222/105 |
| 2008/0260978 | A1 * | 10/2008 | Van Hove | B32B 27/32 264/328.8 |
| 2010/0264166 | A1 * | 10/2010 | Moretti | B05B 15/30 222/105 |
| 2011/0227258 | A1 * | 9/2011 | Patrini | B65D 23/02 264/526 |
| 2015/0344191 | A1 * | 12/2015 | Maurice | B29C 45/14008 264/138 |
| 2016/0184850 | A1 * | 6/2016 | Moretti | B05B 11/1043 222/95 |

FOREIGN PATENT DOCUMENTS

| | | | |
|---|---|---|---|
| FR | 2732315 | A1 | 10/1996 |
| WO | 2017/158209 | A1 | 9/2017 |

* cited by examiner

TUBULAR CONTAINER COMPRISING AN OUTER TUBE AND AN INNER CONTAINER

FIELD OF THE INVENTION

The invention is related to an improved tubular container for housing cosmetics, food, a medicine or similar, particularly a tubular container that includes an outer tube and an inner container inside the outer tube.

PRIOR ART

The use of flexible plastic tubes is very widespread in the cosmetic, pharmaceutical or food sectors. The flexible plastic tubes usually include a body or hollow skirt, intended to house a commercial product (for example, cosmetics, pharmaceuticals or food) and a head, arranged at a proximal end of the skirt and intended to facilitate the outlet of the product. The head may be fitted with a product dispensing neck, a lid, dosing mechanisms, etc. In the manufacture of the different parts of this type of tubes, several known methods of manufacturing are used, for example compression, extrusion, co-extrusion, mould injection, in-mould labeling (IML), etc. Manufacturers of this type of tubular containers usually supply these containers to product marketers with the head of the container dosed, capped, sealed and generally finished, and with a second distal end of the skirt open. The marketers then fill the tubular containers with their product through the open distal end of the skirt. Once the tube has been filled with the commercial product, the distal end of the skirt opposite to the head is sealed by means of heat transfer welding (hot air, hot clamping), ultrasound or another method, whereby the tubular container and the product contained therein are ready for sale to the public.

Airless containers are known in the Prior Art, being provided with an outer tube and an inner container and being capable of preventing the input of air inside the inner container in order to improve the conservation of the packaged product. These airless containers also resolve the collapsing effect of the container when using. For that purpose, the outer tube is capable of keeping or recovering its original shape after dispensing the product whilst the inner container remains deformed after the output of the product. Therefore, the airless container provides better ergonomics and maintains an unchanged appearance throughout the containers useful life.

Due to the conventional manufacturing techniques typically used and also due to the use for which these containers are intended, the use of materials with high specifications and features constitutes an important requirement when manufacturing this type of tubes. From the point of view of the manufacturing techniques, the materials used must comply with diverse processability, weldability, Impermeability, ESCR resistance requirements, etc. For that purpose, polymeric mixtures selected from polymers with specific (fluidity, density, rigidity) and stable features are usually used. Furthermore, regarding the use of the tube, in order to come Into contact with a cosmetic, food or pharmacological product, the polymeric mixtures selected must fulfill strict additional requirements, in relation to food contact, nontoxicity, migrations or others, in accordance with the prevailing regulations of the food, pharmaceutical or cosmetic sector, as appropriate. The tubes are often made out of plastic or metal-plastic laminated complex materials which can combine polymers and metallic sheets.

On the other hand, in an airless tube, the outer tube usually comprises a skirt and a head incorporating means or mechanisms (neck, threads . . . ) to allow and facilitate the output of the product. The inner container also includes a skirt and a second element, which may be a head or a lid without a neck, joined to the outer tube. In spite of its widespread implementation on the market, the manufacture of this type of airless tubular containers involves some problems, the resolution of which may be complex.

In the most conventional solutions, the inner container is provided with a head, like the outer tube, being both heads joined together by their necks. This solution presents shortcomings when it comes to obtaining a high restitution rate (capacity to dispense the entire contents of the tube), as the tubular container cannot collapse fully due to the high level of rigidity of the head of the inner container.

In other alternative solutions for airless containers known in the prior art, the inner container does not actually have a tube head but rather, the inner container is joined or welded to the outer tube so that the inner container shares or makes use of the neck, thread and other elements of the head of the outer tube, to allow for the dispensing of the contents of the tube. Examples of these alternative solutions are disclosed in publications DE10223842A1 and US2008041890A1. Another example of an airless tubular container, in which the inner container is not provided with an actual head, is that described in patent application WO2017158209A1 by the same applicant of the present invention. In the solution of this latter publication, the inner container, housed inside the outer tube, is provided with a skirt and a flexible shoulder or open lid. The skirt and the shoulder of the inner container may be formed separately or jointly. The inner container is then introduced inside the outer tube, welding the shoulder of the inner container to the head of the outer tube. It is advantageous to manufacture the shoulder of the inner container from a multi-layer metal-plastic complex equal or similar to that used for the skirt, later joining the two components by means of welding. The procedure provides a cost-effective container with good shoulder deformation capacity, so that the inner container does not recover its shape and allows for the appropriate collapsing of the inner container. However, these alternative solutions involve a risk of exposure of the metallic components of the multi-layer complex of the inner container in certain key areas, such as, for example on the edge of the shoulder or in the joining area between the skirt and the shoulder of the inner container. Therefore, the manufacturing procedure may require additional measures or steps to obtain a safe container, in the sense of preventing undesired contact between the metal of the metal-plastic complex of the container and the product housed inside. Implementing these additional steps in the manufacturing process of the airless container often involves technical difficulties and/or makes the procedure more expensive.

The present invention aims to provide a new design for an airless tubular container, alternative to existing ones. Furthermore, the new container must help minimise the risk of a possible undesired exposure of the materials used in the manufacture of the tube, for example, an undesired contact between the metal of the metal-plastic complex of the inner container and the product housed in the container, in case this type of multi-layer complex is selected for the inner container.

BRIEF DESCRIPTION OF THE INVENTION

An object of the invention is an airless tubular container for housing cosmetics, food, medication or similar. Another object of the invention is a method of manufacturing this tubular container, in accordance with the independent claims.

Like other airless containers, the tubular container is provided with an outer tube, an inner container and at least one air passage area from the outside of the tubular container towards an intermediate cavity between the outer tube and the inner container. The inner container comprises a skirt arranged around a longitudinal axis. This skirt of the inner container extends between a proximal end and a distal end. The outer tube also comprises a skirt arranged around a longitudinal axis between its proximal end and its distal end. Furthermore, the outer tube includes a head arranged in the proximal end of the skirt.

The tubular container of the invention has the particular feature of having an inner container provided with an adapter with a neck. This adapter is arranged in the proximal end of the skirt of the inner container, around the longitudinal axis of the inner container. The adapter is joined to the head of the outer tube and is also joined to the skirt of the inner container. The skirt of the inner container comprises a first section, extending from the distal end towards the proximal end of the skirt and a second section, extending from the first section towards the neck of the adapter. This second section comprises a deployable portion of the skirt with the particularity that the total length of the skirt of the inner container is equal to the sum of the length of the first section of the skirt plus the length of the deployable portion. The deployable portion is arranged in a position under the adapter and joined to the adapter. The skirts have an adjustable length difference at their distal ends depending on the length of the deployable portion.

The feature of comprising a deployable portion in the skirt of the inner container enables appropriate collapsing when using the container, obtaining a better restitution rate compared to traditional containers provided with two tubes joined by their respective heads. The deployable portion of the skirt of the inner container is a preferential deformation area. This preferential deformation area enables the location under the adapter of an additional quantity or a residuary amount of the material used to make the skirt. During use of the tubular container of the present invention, the deployable portion of the skirt is unfolded as the product housed in the inner container is dispensed. Thereby, the deployable portion helps to compensate the axial stresses, which are typically generated when the product is dispensed, thus enabling a relaxed collapse of the inner container. Deployable is understood in the present invention to be the capacity of this residuary material of the skirt of the inner container, initially essentially placed under the adapter, to unfold and extend from the adapter towards the distal end of the inner container.

Furthermore, the presence of a deployable portion in the skirt of the inner container, instead of a lid or a flexible shoulder, involves additional advantages. The flexible shoulder of other containers known in the prior art is placed at the proximal end of the skirt and is delimited by an upper edge and a lower edge joined to the rest of the skirt. On these edges, the shoulder has a sharp edge or sharp circular contour in which the internal layers of the multi-layer complex are exposed. Therefore, these terminations of the flexible shoulder are risk areas, for example when the skirt is made out of a metal-plastic complex, involving a risk of undesired exposure or contact between the metal of the complex and the commercial product (cream or other cosmetic, pharmacological or food product) that may cause an adverse reaction. Thanks to the structural configuration of the inner container of the invention, provided with an adapter joined to the deployable portion of the skirt, it is possible to minimize and even eliminate (in some particularly advantageous embodiments) the risk of exposure of the metal or other components present in the internal layers of the multi-layer complex at the proximal end of the tubular container.

Another additional advantage of the container of the invention is that the deployable portion minimizes the product retention in the vicinity of the proximal end of the inner container, contributing to savings for the end user, in addition to optimising the collapsing with respect to conventional solutions known in the prior art.

In summary, the invention provides a tubular container having simultaneously the following advantages: enable and facilitate the filling and subsequent sealing of the tubular container for the product marketer, through the distal end, using the same conventional equipment and techniques used for other tubular containers; minimize or even eliminate the risk of an undesired exposure, contact or adverse reaction between the components of the multi-layer complex of the inner container and the commercial product, in the proximal area of the container; provide a high restitution rate; and keep the function of an unchanged airless container in which the inner container is deformed after using the container but the outer tube keeps or recovers its shape.

The invention also relates to a method of manufacturing a doubler tube tubular container, made up of an outer tube and an inner container. The method comprises forming an adapter provided with a neck and joining this adapter to the skirt of the inner container, in a single step or in different steps. The method has the additional peculiarity of forming a first section of the skirt of the inner container, extending from the distal end towards the proximal end of the skirt, as well as forming a second section, extending from the first section towards the neck of the adapter. This second section comprises a deployable portion, being the total length of the skirt of the inner container equal to the sum of the length of the first section plus the length of the deployable portion. The deployable portion is arranged in a position under the adapter and joined to the adapter. The inner container is assembled in the interior of the outer tube, so that the skirts of the outer tube and of the inner container have an adjustable length difference at the distal ends, depending on the length of the deployable portion.

BRIEF DESCRIPTION OF THE FIGURES

The details of the invention can be seen in the accompanying figures, which do not intend to limit the scope of the invention:

FIG. 1 also illustrates a schematic representation of the deployable portion of the skirt of the inner container.

DETAILED DESCRIPTION OF THE INVENTION

Figure 1:
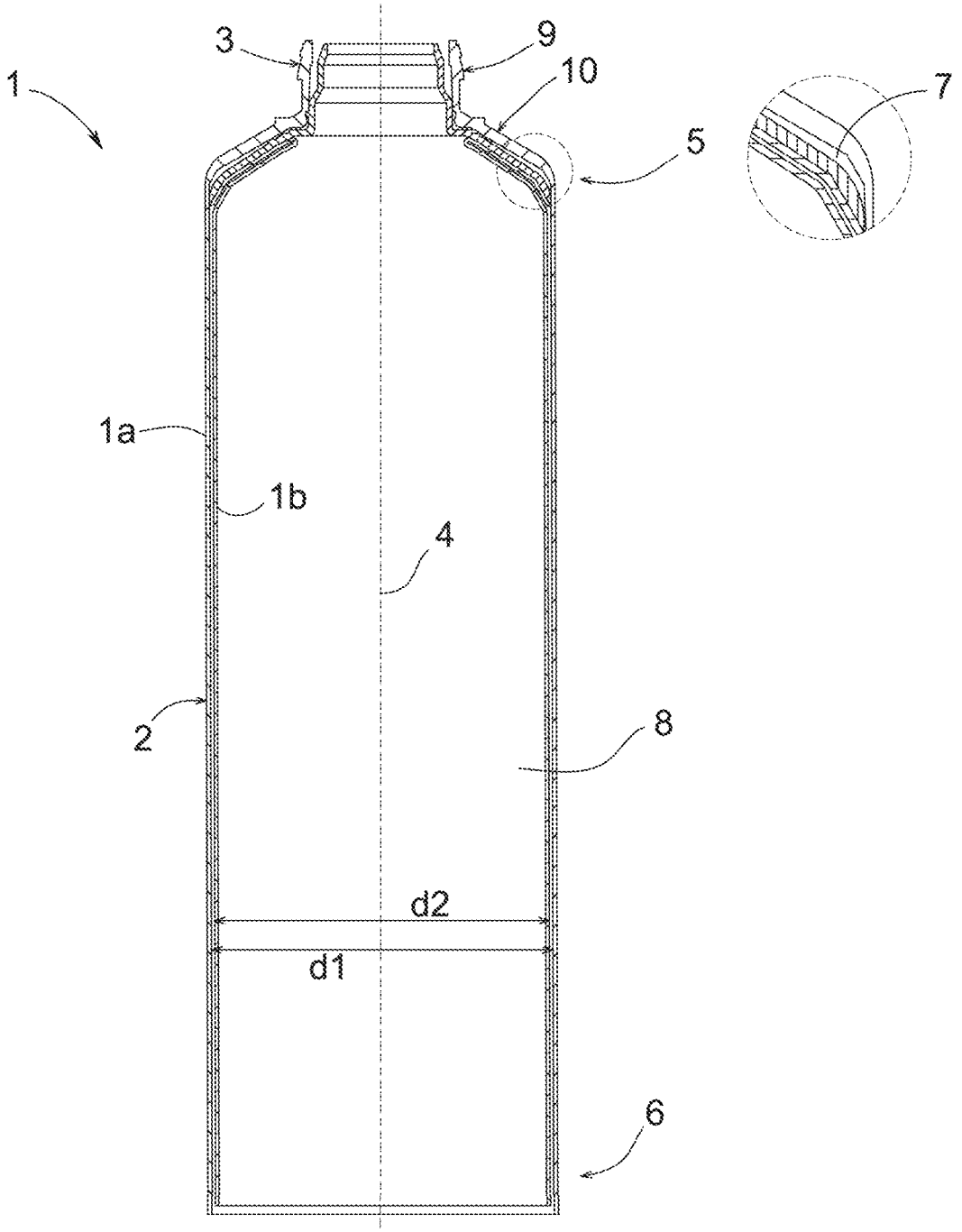
FIG. 1 shows a cross-sectional front elevation view of an embodiment of a tubular container in accordance with the invention, comprising an outer tube and an inner container.

The invention refers to an airless tubular container to house a commercial product (cosmetics, food, pharmacological). FIG. 1 shows an example of an embodiment of the tubular container according to the invention. Like other tubular containers known in the prior art, the tubular container comprises an elongated and hollow body or skirt (2), with a generally cylindrical shape. The skirt (2) is arranged around a central longitudinal axis (4) of the tubular container having a proximal end (5) and a distal end (6). The tubular container also comprises a head (3), this head providing a closure at the proximal end (5) of the skirt (2) and being intended to allow the product to be dispensed. The head of this type of tubes may optionally include a product dispensing neck, a simple lid and/or possible dispensing mechanisms, such as the one shown in FIG. 2. The head may also optionally include diverse anchoring parts or elements, perforations, plugs, variable configuration lids, dosing pumps, applicators, non-drip systems, non-return systems, etc.

Figure 2:
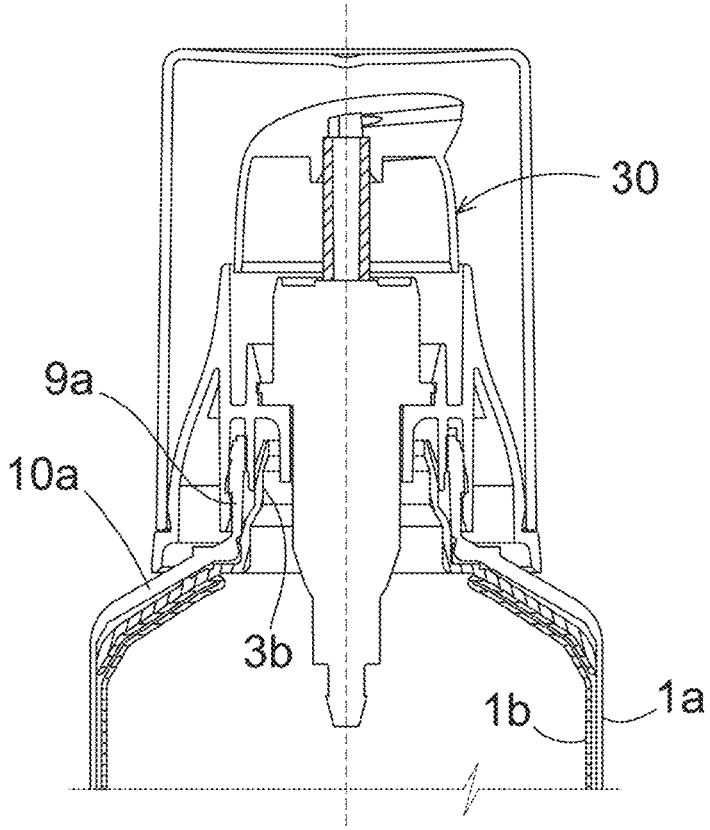
FIG. 2 shows a partial cross-sectional elevation view of the tubular container of FIG. 1, provided with a mechanism coupled to the outer tube and intended to allow the proper dosage of the product housed in the inner container, in accordance with an example of a particular embodiment of this mechanism.
Figure 4:
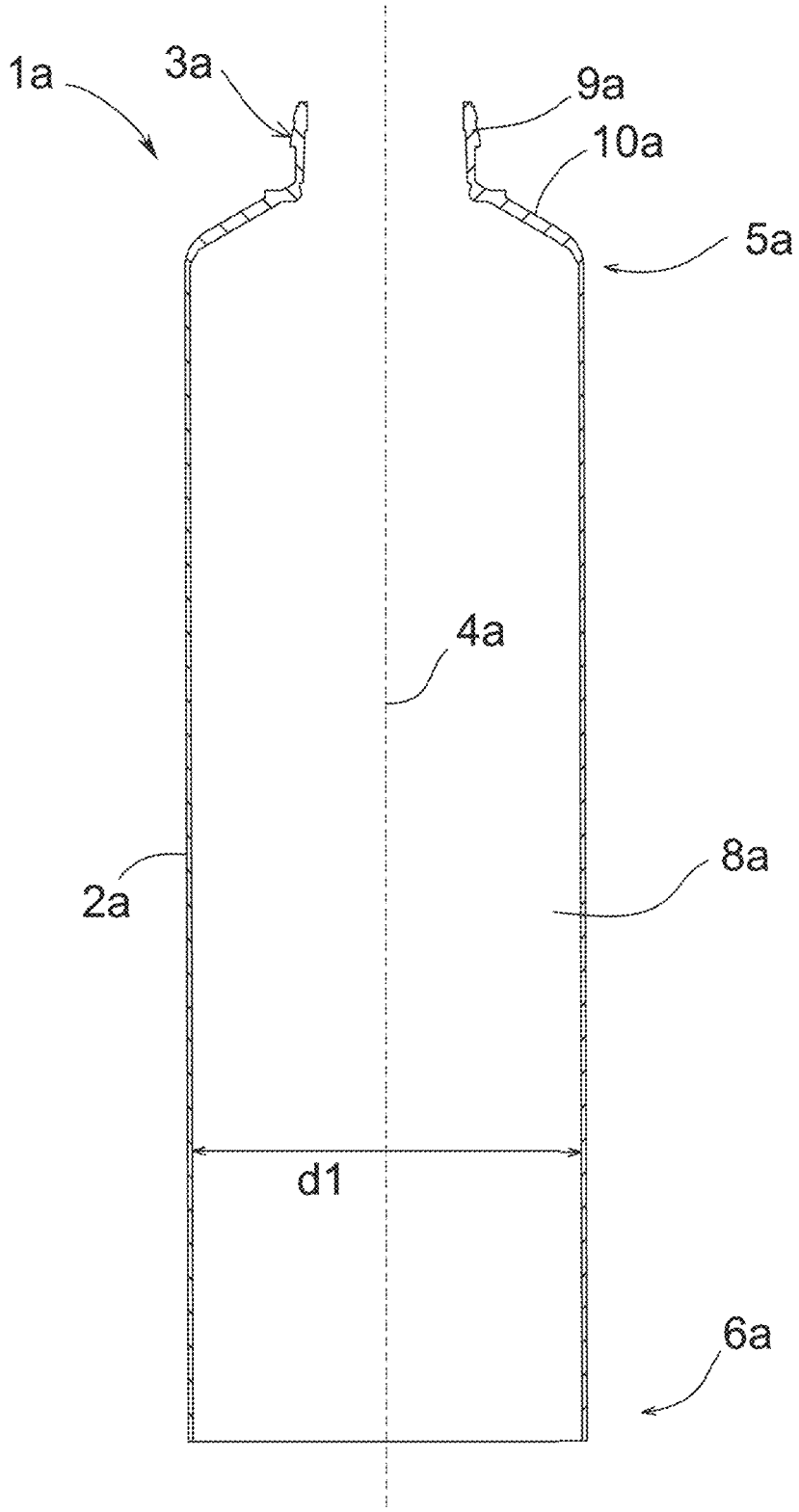
FIG. 4 shows a cross-sectional elevation view of the outer tube of the tubular container of FIG. 1.

As can also be seen in FIG. 1, like other airless containers known in the prior art, the tubular container of the present invention comprises a first outer tube (1*a*) and a second collapsible tube or inner container (1*b*) housed inside the outer tube (1*a*). The outer tube (1*a*), illustrated alone in FIG. 4, comprises a skirt (2*a*) and a head (3*a*). The elongated and hollow skirt (2*a*) has a proximal end (5*a*) and a distal end (6*a*). It is arranged around a central longitudinal axis (4*a*) of the outer tube (1*a*) delimiting an inner space (8*a*). Optionally, as in the embodiment of figures, the skirt (2*a*) is cylindrical in shape with an internal diameter (d1). The head (3*a*), located at the proximal end (5*a*) of the skirt (2*a*), is intended to close the outer tube (1*a*) and allow the product housed inside the tubular container to be dispensed. In this embodiment, the head (3*a*) comprises a shoulder (10*a*) and a neck (9*a*), being the neck (9*a*) arranged next to the shoulder (10*a*) and coupled to the mechanism for applying and dispensing the product, as shown in FIG. 2.

Figure 5:
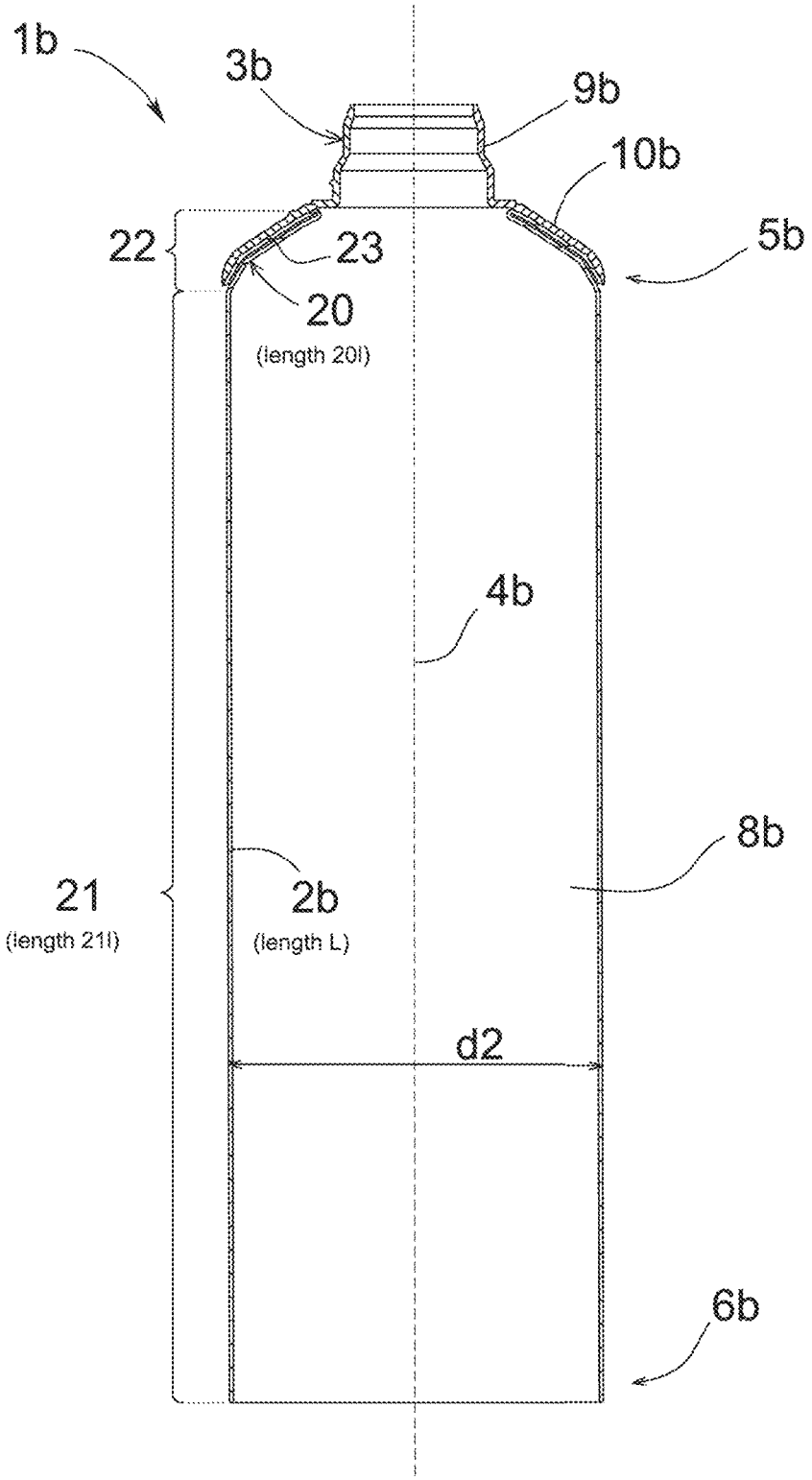
FIG. 5 shows a cross-sectional elevation of the inner container of FIG. 1.

As can be seen in FIG. 5, the inner container (1*b*) also comprises an elongated and hollow skirt arranged around a central longitudinal axis of the inner container (1*b*) delimiting an inner space (8*b*). The skirt of the inner container (1*b*) also has a proximal end (5*b*) and a distal end. Optionally, as in the embodiment of figures, the skirt of the inner container (1*b*) is cylindrical and has an external diameter (d2). As previously mentioned, the inner container (1*b*) of the tubular container is located inside the outer tube (1*a*), more specifically, in the inner space (8*a*) delimited by the skirt (2*a*) and by the head of the outer tube (1*a*). Between the outer tube (1*a*) and the inner container (1*b*), there is an intermediate cavity (see detail of FIG. 1). The distal end of the skirt of the inner container (1*b*) remains open, enabling the inner container (1*b*) to be filled with the product through the lower part of the tubular container.

Figure 3:
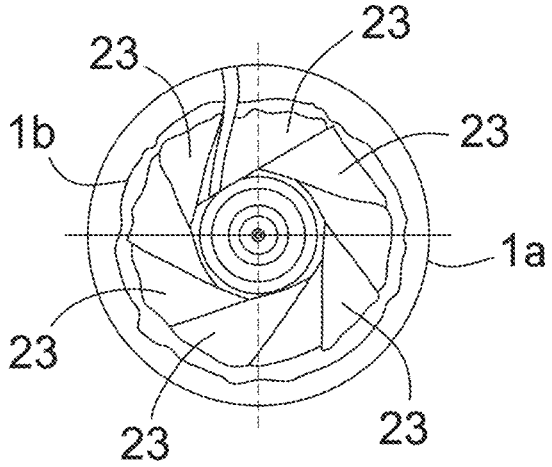
FIG. 3 shows a plan view of the interior of the tubular container, seen from below, showing the configuration of the deployable portion of the skirt.

As also illustrated in the embodiment of FIG. 5, the inner container (1*b*) of the tubular container of the invention has the particularity of including a head or adapter (3*b*) provided with a neck. This adapter (3*b*) is arranged at the proximal end (5*b*) of the skirt extending around the longitudinal axis. The adapter (3*b*) is joined to the head of the outer tube (1*a*) and joined to the skirt of the inner container (1*b*). The skirt of the inner container (1*b*) comprises a first section that is substantially straight or smooth with a length, this first section extending in the direction of the longitudinal axis from the distal end towards the proximal end (5*b*) along a substantial part of the total length of the skirt. The skirt of the inner container (1*b*) also comprises a second section which extends from the first section towards the neck of the adapter (3*b*), being located under the adapter (3*b*). This second section includes a deployable portion (20) of the skirt with a length. This deployable portion is made up of a plurality of folds, forming a preferential deformation area made up of a residuary quantity of the material used to make the skirt of the inner container (1*b*). This residuary material is concentrated in the second section of the skirt under the adapter (3*b*). The configuration of the folds of the deployable portion may vary, presenting, for example, a configuration in the shape of bellows or an accordion. Optionally, like the particular embodiment of figures, the deployable portion comprises a plurality of folds which can be unfolded towards the distal end and which can also be twisted around the longitudinal axis, providing this residuary amount of material. The configuration of these twistable folds is schematically shown in FIGS. 1, 2, 5, 6 and 7 and can be seen in greater detail in the lower plan view of the interior of the tubular container shown in FIG. 3. In addition, the skirt of the inner container (1*b*) of the invention has a total length equal to the sum of the length (20*l*) of the deployable portion plus the length of the straight first section (21*l*). The inner container (1*b*) of the invention has the particular advantage of enabling to adjust a longer or a shorter length for the first section (21*l*), depending on the configuration of the deployable portion. The advantages of this feature will be explained in greater detail herein.

Figure 6:
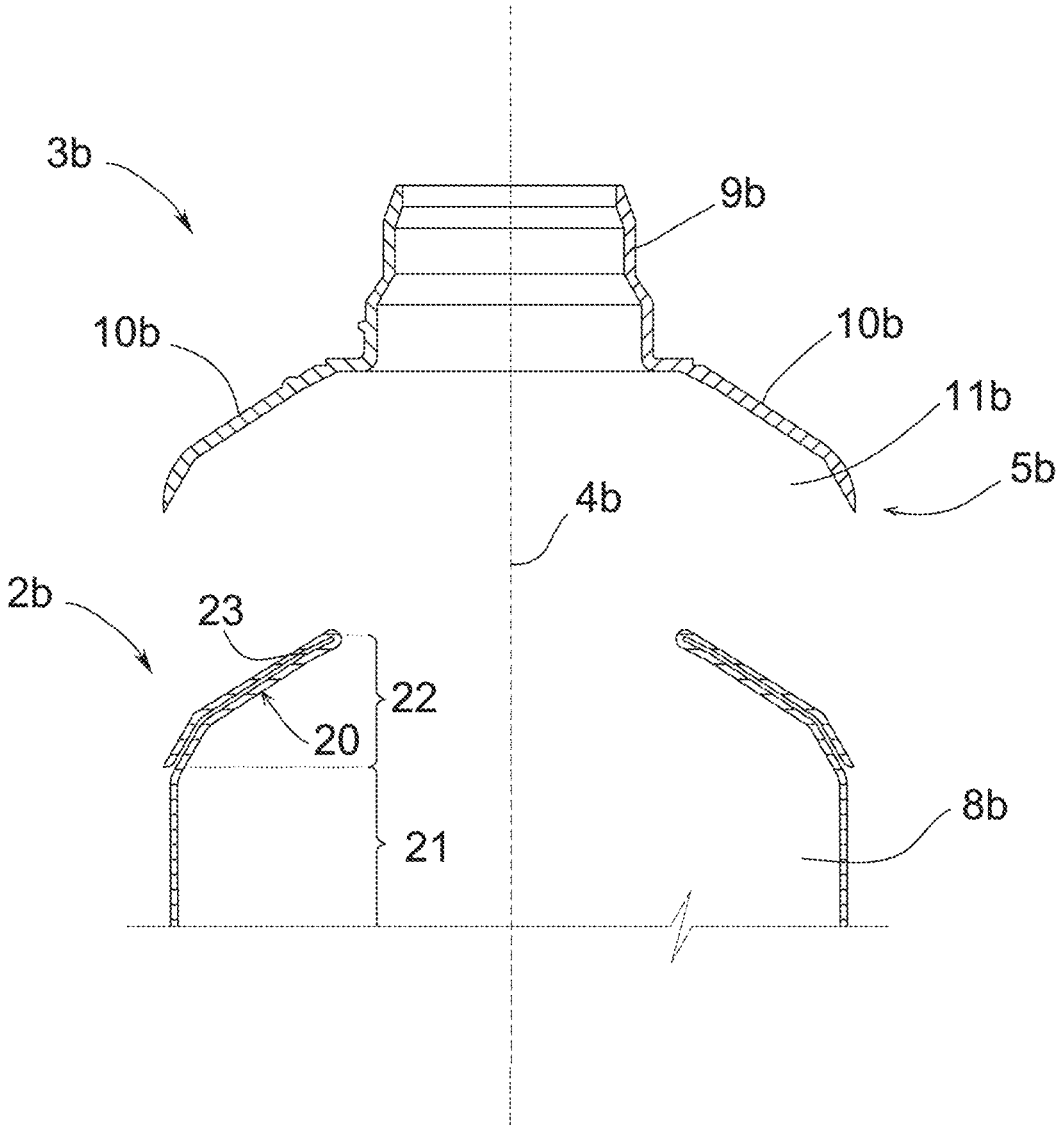
FIG. 6 shows an exploded elevation view of the inner container, illustrating the adapter and the skirt separately.

FIG. 6 shows a partial exploded view of the inner container (1*b*), for the present embodiment, illustrating the adapter (3*b*) and the skirt separately. Optionally, as in this embodiment example, the adapter (3*b*) of the inner container (1*b*) is provided with a neck radially arranged around the longitudinal axis and also provided with an inclined shoulder (10*b*). This inclined shoulder (10*b*) comprises a frustoconical shaped wall that delimits an inner space or housing (11*b*) intended to at least partially house the deployable portion of the skirt. The housing (11*b*) is specifically delimited by an inner wall of the shoulder (10*b*) of the adapter (3*b*). In the embodiment of figures, the tubular container is represented in an initial rest position, in which the tubular container has not yet been used and the deployable portion of the skirt of the inner container (1*b*) is substantially located inside the housing (11*b*) delimited by the adapter (3*b*). In this initial position, the straight first section is substantially stretched and the folds of the second section are folded and simultaneously twisted, being the deployable portion almost totally or substantially housed in the frustoconical shaped housing (11*b*) under the adapter (3*b*).

As also illustrated in the figures, one end of the deployable portion (20) of the skirt is joined to the adapter (3*b*). In this embodiment, a final untwisted fold of the deployable portion is joined to the inner wall of the shoulder (10*b*) of the adapter (3*b*). Optionally, the adapter (3*b*) and the deployable portion of the skirt of the inner container (1*b*) are joined by means of welding, with a sealing around the entire perimeter of the longitudinal axis. Other joining methods are allowed provided they ensure a sealed union that prevents the product from escaping from the inner container (1*b*) towards the intermediate cavity between the outer tube (1*a*) and the inner container (1*b*). The adapter (3*b*) may be over-injected onto the skirt.

Thanks to the structural configuration of the union between the adapter (3*b*) and the deployable portion, without any sharp edges, the invention provides a tubular container that eliminates the risk of a possible undesired exposure or contact between the material of the internal layers of the multi-layer complex of the skirt and the product housed in the inner container (1*b*) during use of the tubular container. Optionally, like in the embodiment of figures, the skirt of the inner container (1*b*) is made up of a single piece made out of a plastic or metal-plastic multi-layer complex, so that there is no union between the first section and the second section. This advantageous embodiment fully eliminates the risk of exposure in the proximal end (5*b*) of metal or other components present in the multi-layer complex of the skirt of the inner container (1*b*).

The preferential deformation area provided by the deployable portion allows for a relaxed collapsing of the inner container (1*b*) and a better restitution rate, simultaneously taking advantage of the functions provided by an adapter (3*b*) that may be provided with rigid parts, as will be detailed herein.

In the embodiment in the figures, the shoulder (10*b*) of the adapter (3*b*) is frustoconical. Alternative embodiments are contemplated in which the shape of the shoulder (10*b*) may vary, provided its configuration allows for an appropriate union with the deployable portion of the skirt of the inner container (1*b*) and appropriate collapsing when using the tubular container. For example, embodiments of the invention are contemplated in which the shoulder (10*b*) of the adapter (3*b*) of the inner container (1*b*) has a smaller or almost null inclination, having the adapter (3*b*) a straight horizontal shoulder (10*b*).

Figure 7:
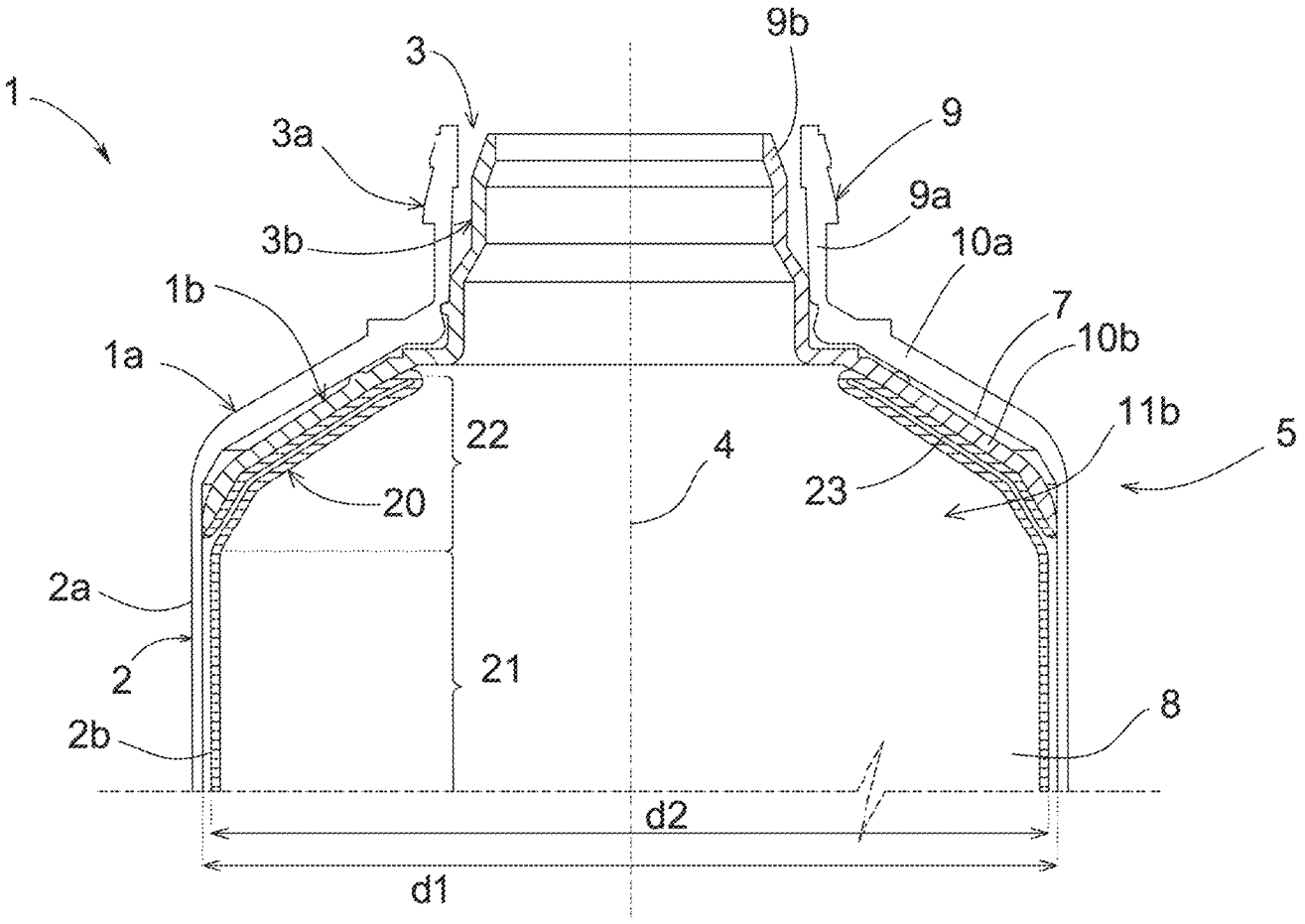
FIG. 7 shows an enlarged view showing details of the union between the head of the outer tube and the adapter of the inner container of FIG. 1.
Figure 8:
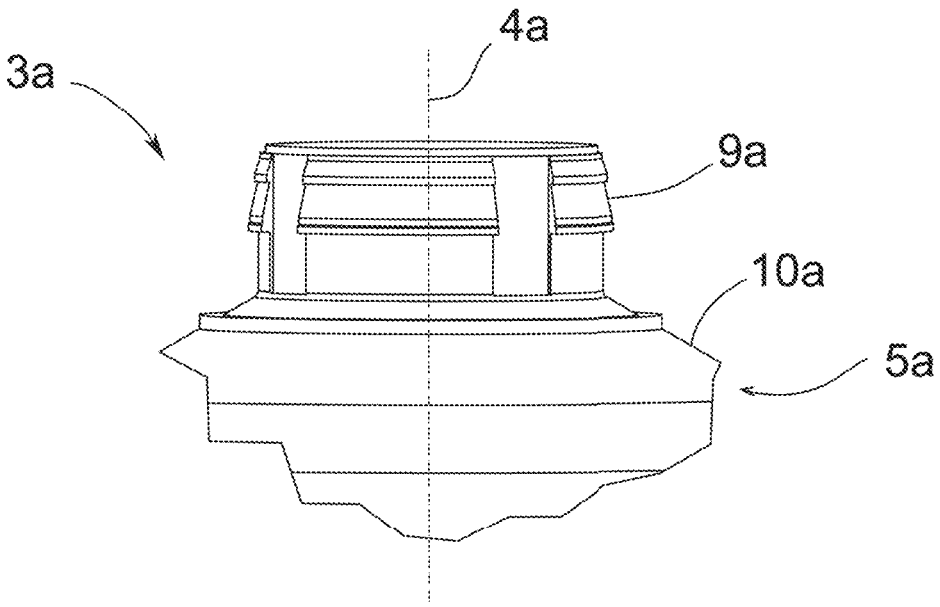
FIG. 8 shows a detailed perspective view of the head of the outer tube.

FIG. 7 shows an enlarged view illustrating in greater detail the union between the head of the outer tube (1*a*) and the adapter (3*b*) of the inner container (1*b*) for this embodiment. The perspectives of FIGS. 8 and 9 respectively show details of the head of the outer tube (1*a*) and of the adapter (3*b*) of the inner container (1*b*) of FIG. 7.

Figure 9:
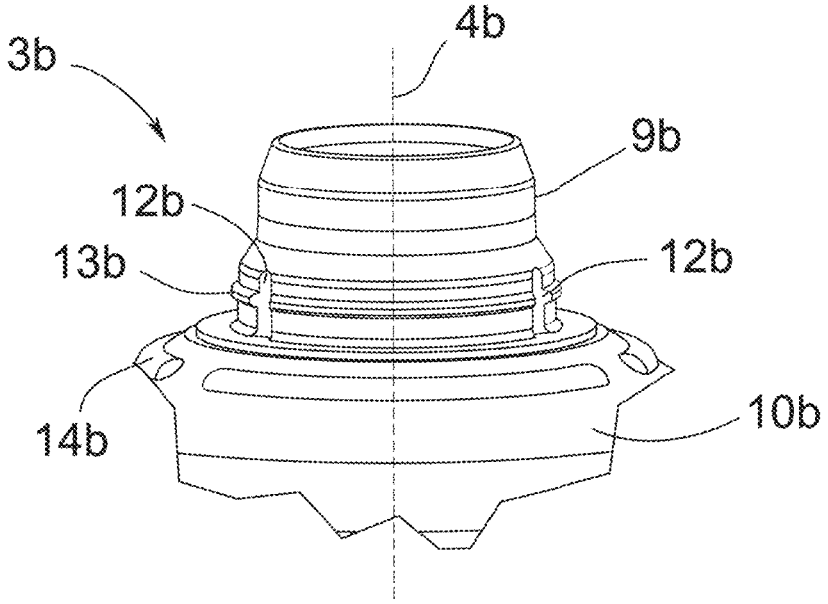
FIG. 9 shows a detailed perspective view of the adapter of the inner container, showing the connection elements and air passage areas.

As previously mentioned, the adapter (3*b*) of the invention is connected to the skirt of the inner container (1*b*) and also to the head of the outer tube (1*a*). Furthermore, the tubular container of the invention comprises at least one air passage area from the exterior of the tubular container towards the intermediate cavity between the outer tube (1*a*) and the inner container (1*b*), providing an immutable tubular container. As shown in FIG. 9, in this embodiment, this air passage area, required for the input of air towards the intermediate cavity, is implemented by means of several vertical grooves or channels (12*b*), located at the neck of the adapter (3*b*) and radially arranged around the longitudinal axis.

Preferably, like in the embodiment of figures, the union between the adapter (3*b*) and the head of the outer tube (1*a*) is mechanical, offering an appropriate solution due to its simplicity and cost. The mechanical coupling can be implemented, for example, like in the embodiment in the figures, by means of a radial protrusion (13*b*) of the adapter (3*b*). This radial protrusion (13*b*) allows for a clipping union between the adapter (3*b*) and the head of the outer tube (1*a*), in a simple way, enabling input of air between the outer tube (1*a*) and the adapter (3*b*) and preventing relative axial movements between both components.

Optionally, like in the embodiment in the figures, the adapter (3*b*) of the inner container (1*b*) is essentially rigid and practically does not participate in the collapsing, when the product in the tubular container is dispensed during use, being this function mainly implemented by the skirt of the inner container (1*b*). In the present invention, it will be understood that the adapter (3*b*) of the inner container (1*b*) is rigid or includes rigid parts, understanding the term rigidity in the sense of presenting a very limited deformation capacity, in contrast with the skirt of the inner container (1*b*) which is much more flexible or deformable to allow the airless function of the tubular container. For example, the skirt of the inner container (1*b*) may be made out of a plastic or metal-plastic multi-layer complex, presenting a plastic or elastic deformation that provides the required flexibility for collapsing.

Optionally, the adapter (3*b*) includes a rigid part, for example the neck, which implements the described mechanical function, and a less rigid part, for example the shoulder (10*b*) or a part of the shoulder (10*b*). In these alternative embodiments of the invention, other than the one illustrated in figures, the shoulder (10*b*) or part of the shoulder (10*b*) can be manufactured using a more deformable material than the neck (9*b*), facilitating the union between the adapter (3*b*) and the deployable portion of the skirt. In such embodiments, the deployable portion (20) with greater flexibility is the preferential deformation area as well, but the shoulder (10*b*) may undergo some deformation. In summary, embodiments of the invention provided with a partially rigid adapter (3*b*) comprising a part with intermediate rigidity are also contemplated, wherein this intermediate rigidity part facilitates the union between the adapter (3*b*) and the skirt and contributes positively to the collapsing of the inner container (1*b*). Obtaining an adapter (3*b*) of this type, provided with parts with a different level of rigidity, can be achieved using pieces with a different thickness or by means of injection moulding of two materials of different rigidity.

In addition to providing the union with the deployable portion of the skirt and favouring collapsing, the adapter (3*b*) of the inner container (1*b*) of the invention provides additional advantages. The rigidity of at least one part of the adapter (3*b*) provides a more resistant assembly between the adapter (3*b*) and the head of the outer tube (1*a*) and an increased resistance to traction, in comparison, for example, with solutions in which the inner container has a flexible shoulder without a head. The adapter (3*b*) of the invention also provides the required sealing between the upper part of the neck and the adjacent element of the head (3*a*) of the outer tube (1*a*). In the preferred embodiment of figures, the head of the outer tube (1*a*) is coupled to a dosing pump (30) (see FIG. 2), intended to facilitate the output of the product during use of the tubular container, whereby the neck of the adapter (3*b*) in this case remains in contact with a ring of the dosing pump (30) providing the required sealing.

Optionally, the joint between the adapter (3*b*) and the head of the outer tube (1*a*) can be made alternatively or further reinforced by means of ultrasound welding. In the embodiment of FIG. 9, a protrusion or cord (14*b*) is provided for the aforementioned ultrasound welding. The welded union provides additional security, which could be important in certain application of the tubular container, in which the axial stresses that occur during collapsing could have a negative effect on the sealing or other functions of the tubular container. Therefore, the welded union may be used to prevent relative rotation movements between the adapter (3*b*) and the head (3*a*), improving the performance of the coupling between the adapter (3*b*), the head of the outer tube (1*a*) and the product dispensing mechanism. Furthermore, the welded union introduces the possibility of choosing more rigid multi-layer complexes for the manufacturing of the skirt of the inner container (1*b*) (providing a greater unfolding effect of the deployable portion) or the possibility of using adapters (3*b*) made of more flexible and/or lighter materials).

Other union methods between the adapter (3*b*) and the head of the outer tube (1*a*), such as a heat or adhesive union, are also compatible with the invention. Embodiments of the invention with head comprising other different mechanisms, such as, for example a single-direction valve for the dispensing of the product held in the inner container (1*b*) are also contemplated.

In relation to the distal configuration of the tubular container, preferably the outer tube (1*a*) and the inner container (1*b*) are substantially coaxial, so that their longitudinal axes (4*a*, 4*b*) are substantially parallel and present a minimum separation, being the magnitude of this tolerance or minimum separation preferably around hundredths of a millimetre or, optionally, around tenths of a millimetre. Therefore, when the outer tube (1*a*) and the inner container (1*b*) are essentially cylindrical, like in the embodiment of figures, the walls of the skirts (2*a*, 2*b*) of the outer tube (1*a*) and of the inner container (1*b*) extend in the direction of the longitudinal axis (4) and the exterior diameter (d2) of the inner container (1*b*) and the interior diameter (d1) of the outer tube (1*a*) have a clearance or minimum tolerance, also preferably around hundredths of a millimetre and optionally around tenths of a millimetre, at the distal ends (6*a*, 6*b*) of both skirts (2*a*, 2*b*). The maintenance of this coaxiality facilitates the filling process and welding by the marketer of the product, so that this procedure can be carried out with conventional welding facilities and parameters.

Figure 10C:
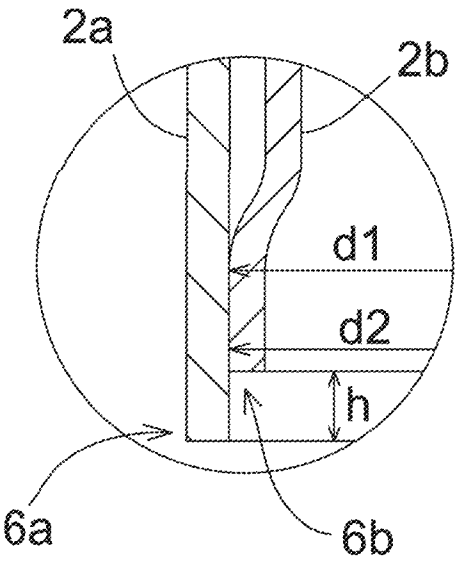
FIGS. 10A, 10B and 10C show a cross-sectional detailed view of the distal end of the skirts of the outer and inner tubes, in accordance with different alternative embodiments.
Figure 10B:
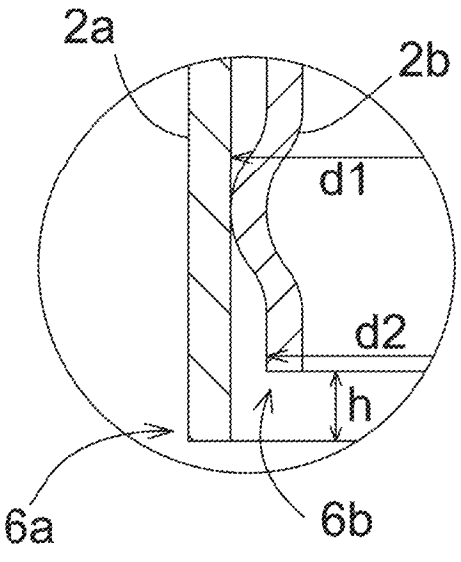
Figure 10A:
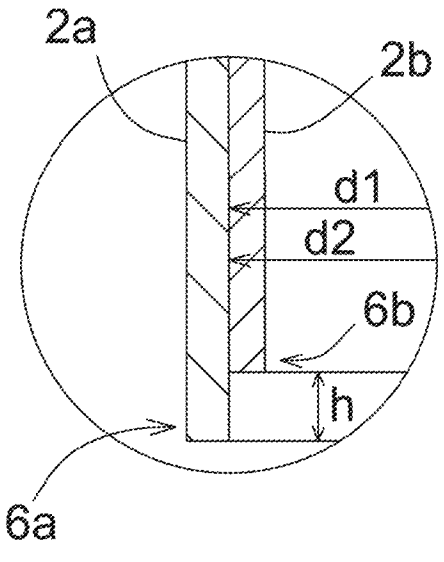

FIGS. 10A, 10B, 10C show a sectional detail of different alternative embodiments for the execution of the distal ends (6*a*, 6*b*) of the skirts (2*a*, 2*b*) of the outer tube (1*a*) and of the inner container (1*b*). The execution of the distal ends (6*a*, 6*b*) in the preceding figures match the execution of FIG. 10A (there is a clearance or tolerance between skirts (2*a*, 2*b*) although it cannot be appreciated in figures). The tolerance of around tenths of a millimetre can be used in certain embodiments of the tubular container, facilitating the assembly between the outer tube (1*a*) and the inner container (1*b*) or keeping other possible tolerances required in the manufacturing procedure.

Optionally, like in the embodiment in FIG. 10B, the tubular container comprises one or several union points between the walls of the skirts (2*a*, 2*b*) in an area close to the distal ends (6*a*, 6*b*). Optionally, the number of union points is even and these union points are located in radial positions, between the walls of the outer tube (1*a*) and the inner container (1*b*). The union can be made using different methods known in the prior art, for example by means of welding (ultrasound, high frequency, heat), gluing or adhesive, etc. This optional feature enables the axial position of the distal end to be fixed to the skirt of the inner container (1*b*) with respect to the distal end (6*a*) of the skirt (2*a*) of the outer tube (1*a*), contributing positively to the maintenance of the appropriate level of coaxiality between the skirts (2*a*, 2*b*), during the manufacturing process and later until the subsequent filling of the tubular container.

Optionally, like in the alternative embodiment of FIG. 10C, the distal end of the skirt of the inner container (1*b*) is widened, by means of plastic adaptation, so that the exterior diameter (d2) of the inner container (1*b*) is equal to the internal diameter (d1) of the outer tube (1*a*) and so that both skirts (2*a*, 2*b*) are in contact in an area dose to the distal ends (6*a*, 6*b*). Optionally, in the embodiment in FIG. 10C, radial welding can also be applied in discrete points or continuously along a perimeter band, in order to reinforce the fixing of the relative axial position between the walls of the outer tube (1*a*) and the inner container (1*b*).

Both in the preferred embodiment of FIG. 10A and in the alternative embodiments of FIGS. 10B and 10C, the distal end of the skirt of the inner container (1*b*) is not a free end, in the sense that the longitudinal and axial position of said end must be maintained once the manufacture of the tubular container is completed, during the subsequent handling and later until the filling of the tubular container with the commercial product has been completed. Once the distal end (6) of the tubular container has been sealed, distal fixing is maintained (6) also during use and collapsing.

As previously mentioned, the deployable portion of the inner container (1*b*) of the invention helps compensate the forces or axial stresses, which are generated during collapsing as a result of the use of the tubular container and as a result of the distal fixing of the inner container (1*b*).

Other embodiments of the distal ends (6*a*, 6*b*) are contemplate for keeping the coaxiality between both tubes, compensating possible axial forces and keeping the skirts (2*a*, 2*b*) in an axial position to facilitate the sealing of the distal ends (6*a*, 6*b*), provided that the commercial interest of the tubular container is guaranteed for product marketers.

Other non-cylindrical forms are also possible, for example an elliptical shape, for the outer tube (1*a*) and the inner container (1*b*).

In addition, preferably, as shown in the three embodiments of the distal ends illustrated in FIGS. 10A-10C, the distal end (6*a*) of the skirt (2*a*) of the outer tube (1*a*) protrudes a length (h) with respect to the distal end of the skirt of the inner container (1*b*). In other words, in the tubular container of the present invention, the skirts (2*a*, 2*b*) have a variable and adjustable length difference (h), depending on the length (21*l*) of the straight first section of the skirt of the inner container (1*b*) at its distal ends (6*a*, 6*b*) or, what is the same, the skirts (2*a*, 2*b*) have in the distal ends (6*a*, 6*b*) a variable and adjustable length difference (h) in accordance with the length (20*l*) of the deployable portion. Therefore, the invention enables this length difference (h) to be controlled and adjusted through the configuration of the deployable portion, for example depending on the level of torsion or depending on the number of folds of the deployable portion of the skirt, so that this final tolerance final is appropriate for the manufacturer of the tubular container as well as for the marketer. The possibility of adjusting the length (21*l*) of the first section and, therefore, the differential length (h) of the distal ends (6*a*, 6*b*) through the configuration of the deployable portion (20) of the skirt provides a versatile tubular container with additional advantages and possibilities: making this length adaptation in accordance with different features (thickness, rigidity . . . ) of the mufti-layer complex of the skirt; protecting the distal end of the inner container (1*b*), avoiding the formation of undesired folds during handling or transporting the tubular container prior to the sealing of the distal ends (6*a*, 6*b*); or offering different configurations for the distal ends (6*a*, 6*b*) which facilitate welding in different cases, for example when the manufacturing materials of the inner container (1*b*) and outer tube (1*a*) are made out of the same material or when they are made out of different materials with different compatibilities and welding requirements.

The invention also relates to a method of manufacturing the tubular container. An example of the method is detailed below.

In one embodiment of the method, the facilities to manufacture the tubular container comprise a carrousel with five stations for the shaping of the body or skirt of the inner container (1*b*), the addition of the adapter (3*b*), the formation of the deployable portion of the skirt and the addition of the outer tube (1*a*) to the inner container (1*b*).

On one side, the outer tube (1*a*) is produced using any of the techniques known in the prior art, such as extrusion, injection, blow-extrusion or film-shaping.

Additionally, the skirt and the adapter (3*b*) of the inner container (1*b*) are produced. To do so, the adapter (3*b*) is shaped by compression (other techniques known in the prior art are allowed) and the adapter (3*b*) is welded to the skirt. The shaping steps of the adapter (3*b*) and welding of the adapter (3*b*) to the skirt may be performed simultaneously or the adapter (3*b*) can be shaped first, followed by the welding. The adapter (3*b*) may also be over-injected onto the skirt.

In the embodiment of the figures, the termination of the deployable portion of the skirt is welded to the inner surface of the shoulder (10*b*) of the adapter (3*b*) to form the inner container (1*b*). The welding may be, for example, using hot air, conduction, ultrasound, or any method that is appropriate in accordance with the materials that make up the inner container (1*b*).

Figure 13:
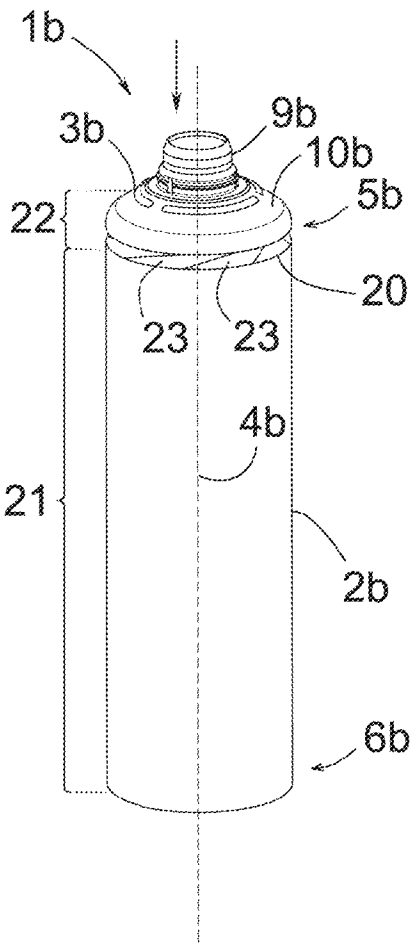
FIGS. 11, 12 and 13 illustrate the formation sequence of a particular embodiment of the deployable portion of the skirt of the inner container.
Figure 12:
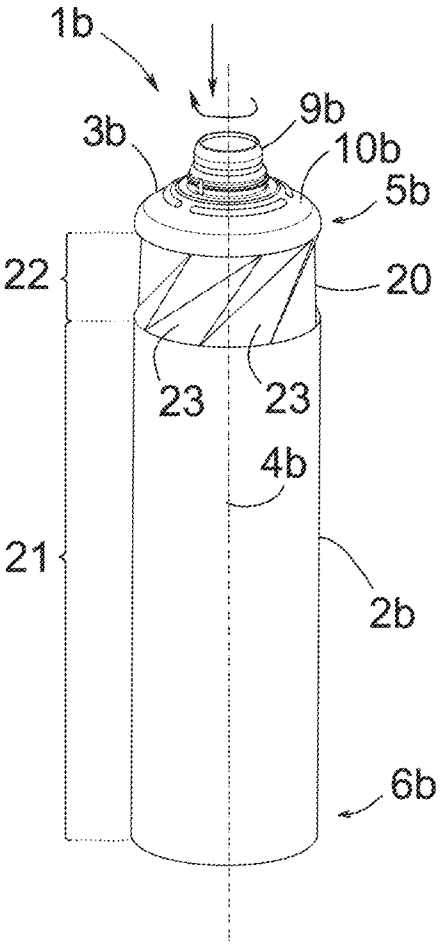
Figure 11:
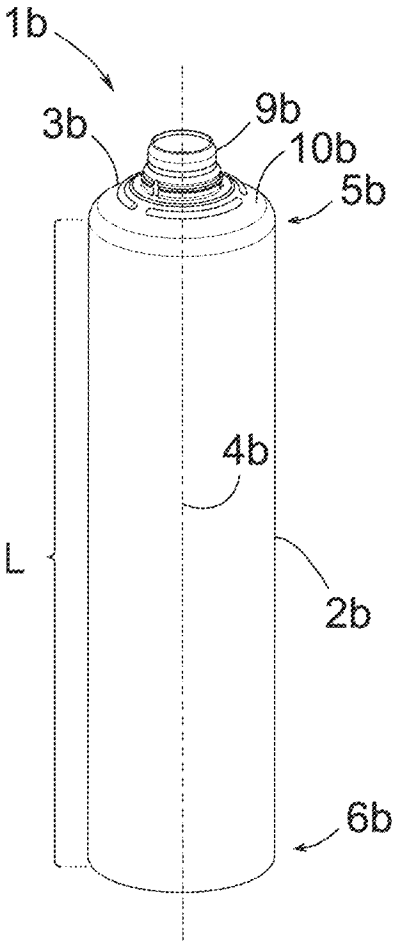

FIGS. 11, 12 and 13 illustrate the formation sequence of a particular embodiment of the deployable portion of the skirt of the inner container (1*b*). Starting from the situation of FIG. 11, the skirt with a length is secured by its distal end and the adapter (3*b*) is turned for the formation of the deployable portion of the skirt. In the embodiment of figures, the deployable portion is made up of a plurality of twistable folds defining the preferential deformation area. The turning of the adapter (3*b*), illustrated in FIG. 12, may be accompanied by a displacement of the adapter (3*b*) in the direction of the longitudinal axis and towards the distal end. Optionally, as shown in FIG. 13 for this embodiment, a second displacement of the adapter (3*b*) may be made in the direction of the longitudinal axis and towards the distal end, in order to ensure that a substantial part of the deployable portion of the skirt remains hidden inside a housing (11*b*) under the adapter (3*b*). This second displacement movement may be unnecessary in some embodiments of the invention, different to the one represented in the figures, when the adapter (3*b*) is provided with a shoulder (10*b*) with a smaller or horizontal inclination.

Once the manufacture of both components of the tubular container is completed, assembly is carried out to place the inner container (1*b*) inside the outer tube (1*a*), to make the union between the outer tube (1*a*) and the inner container (1*b*) and so that the skirts (2*a*, 2*b*) have an adjustable length difference (h) at their distal ends (6*a*, 6*b*) depending on the length (20*l*) of the deployable portion. The outer tube (1*a*) and the inner container (1*b*) are preferably mechanically coupled and optionally or additionally welded. At the distal ends (6*a*, 6*b*) of the skirts (2*a*, 2*b*) one or several welding or adhesive points cam be added and/or a widening of the distal end of the inner container (1*b*) can be implemented.

In relation to the possible manufacturing materials, the outer tube (1*a*) and the inner container (1*b*) may be made out of formulations of plastic materials, plastic complexes, metal-plastic complexes, layers of other materials, combinations of the former and, in general, from any material or formulation applicable for tubes of flexible materials, such as polypropylenes, polyethylenes, polyolefin co-polymers, laminated complexes comprising aluminium, laminated complexes comprising EVOH (Ethylene-Vinyl-Alcohol) or others.

Optionally, the inner container (1*b*) is obtained from a metal-plastic complex that comprises aluminium or from another type of structures (such as metalized sheets, additive single-layer laminates, inorganic layers) which act as a barrier. Optionally, the metal-plastic complex used for the manufacture of the skirt of the inner container (1*b*) comprises EVOH (Ethylene-Vinyl-Alcohol), which is appropriate due to its good barrier properties and low permeability to oxygen and other gases. Using a non-metal complex, which includes for example EVOH for the manufacture of the inner container (1*b*), also offers advantages related to the prevention of the risk of undesired exposure. In this case, there is no risk of having an adverse reaction like in the case of a metal and plastic complex, but a possible loss of permeability is prevented in the proximal end (5) of the tubular container.

In other embodiments, the inner container (1*b*) may be made out of a single layer film or from a film that includes an inorganic barrier material.

The invention claimed is:

1. A tubular container comprising an outer tube, an inner container and at least one air passage area from the exterior of the tubular container towards an intermediate cavity between the outer tube and the inner container, wherein the inner container comprises a skirt arranged around a longitudinal axis and having a proximal end and a distal end, wherein the outer tube comprises a skirt arranged around a longitudinal axis and having a proximal end, a distal end and wherein the outer tube comprises a head placed in the proximal end, wherein the tubular container is characterised in that:

the inner container comprises an adapter having a neck, being the adapter arranged at the proximal end of the skirt of the inner container around the longitudinal axis, joined to the head of the outer tube and joined to the skirt of the inner container;

the skirt of the inner container comprises a first section, having a length and extending from the distal end towards the proximal end of the skirt, and a second section, extending from the first section towards the neck of the adapter, wherein the second section comprises a deployable portion of the skirt with a length, being the total length of the skirt equal to the sum of the length of the first section plus the length of the deployable portion, wherein the deployable portion is located under the adapter and joined to the adapter; and wherein the skirts have an adjustable length difference at the distal ends depending on the length of the deployable portion.

2. The tubular container, in accordance with claim 1, wherein the deployable portion comprises a plurality of twistable folds around the longitudinal axis, wherein these twistable folds can be unfolded towards the distal end of the skirt of the inner container.

3. The tubular container, in accordance with claim 1, wherein the skirt of the inner container is made up of a single piece.

4. The tubular container, in accordance with claim 1, wherein the neck of the adapter is radially arranged around the longitudinal axis, comprising the adapter a frustoconical shoulder provided with an inclined wall delimiting a housing, wherein the deployable portion comprises a plurality of twistable folds around the longitudinal axis, wherein the twistable folds can be unfolded towards the distal end of the skirt of the inner container, being a nontwisted final fold of the deployable portion joined to the shoulder of the adapter and being the deployable portion at least partially housed inside the housing.

5. The tubular container, in accordance with claim 1, wherein the neck of the adapter is radially arranged around the longitudinal axis, the adapter also comprising a straight shoulder that is substantially horizontal.

6. The tubular container, in accordance with claim 1, wherein the air passage area is implemented by means of one or several vertical channels located in the adapter and radially arranged around the longitudinal axis of the inner container.

7. The tubular container, in accordance with claim 1, wherein the adapter is mechanically coupled to the head of the outer tube.

8. The tubular container, in accordance with claim 7, wherein the mechanical coupling is made using a clipping union.

9. The tubular container, in accordance with claim 1, wherein the union between the adapter and the head of the outer tube is made by means of welding or further reinforced by means of welding, or the union between the adapter and the head of the outer tube is made using adhesive or further reinforced using adhesive.

10. The tubular container, in accordance with claim 1, wherein the adapter is essentially rigid, compared to the skirt of the inner container which presents a higher plastic or elastic flexibility or deformation capacity.

11. The tubular container, in accordance with claim 1, wherein the adapter comprises at least one essentially rigid part, for example a neck radially placed around the longitudinal axis, and an intermediate rigidity part, for example an inclined or straight shoulder with respect to the neck, in comparison with the skirt of the inner container-which presents a higher level of plastic or elastic flexibility or deformation capacity.

12. The tubular container, in accordance with claim 1, wherein the head of the outer tube is coupled to a dosing pump intended to facilitate the output of a product housed inside the inner container.

13. The tubular container, in accordance with claim 1, wherein the longitudinal axes of the outer tube and of the inner container are substantially parallel and present a minimum tolerance, so that the outer tube and the inner container are substantially coaxial.

14. The tubular container, in accordance with claim 13, wherein the tolerance is around hundredths of a millimetre.

15. The tubular container, in accordance with claim 13, wherein the tolerance is around tenths of a millimetre.

16. The tubular container, in accordance with claim 13, wherein the skirts present a cylindrical shape and extend in the direction of the longitudinal axes, having the skirt of the outer tube an inner diameter and having the skirt of the inner container an outer diameter, so that the skirts present a minimum clearance at the distal ends, being this minimum clearance preferably around tenths of a millimetre and even more preferable around hundredths of a millimetre.

17. The tubular container, in accordance with claim 1, wherein the distal end of the skirt of the inner container is widened by means of plastic deformation, so that both skirts are in contact in an area close to the distal ends.

18. The tubular container, in accordance with claim 1, comprising one or several union points in an area close to the distal ends of the skirts between the walls of the outer tube and the inner container.

19. A method of manufacturing a double-tube tubular container, comprising the steps of:

forming an outer tube with a skirt comprising a proximal end and a distal end;

forming a skirt of an inner container, wherein the skirt comprises a proximal end and a distal end;

forming an adapter provided with a neck and joining the adapter to the skirt of the inner container, in a single step or in different steps;

forming a first section of the skirt of the inner container, having a length and extending from the distal end towards the proximal end, and forming a second section, extending from the first section the neck of the adapter, wherein the second section comprises a deployable portion of the skirt with a length, being the total length of the skirt equal to the sum of the length of the first section plus the length of the deployable portion;

arranging the deployable portion in a position under the adapter and joined to the adapter; and assembling the inner container in the interior of the outer tube so that the skirts have an adjustable length difference at their distal ends depending on the length of the deployable portion.

20. The method of manufacturing, in accordance with claim 19, wherein the step of forming the deployable portion comprises turning the adapter around the longitudinal axis of the inner container for the formation of a plurality of twistable folds which can be unfolded towards the distal end of the inner container.

21. The method of manufacturing, in accordance with claim 20, wherein the adapter is simultaneously turned and displaced in the direction of the longitudinal axis and towards the distal end of the inner container.

22. The method, in accordance with claim 21, further comprising a step of displacing the adapter in the direction of the longitudinal axis and towards the distal end of the inner container, so that at least one part of the deployable portion is housed inside a housing under the adapter.

23. The method of manufacturing, in accordance with claim 19, wherein the union between the outer tube and the inner container is performed by means of a mechanical coupling between the adapter of the inner container and the head of the outer tube.

24. The method of manufacturing, in accordance with claim 23, wherein the union between the outer tube and the inner container is performed or reinforced by means of welding or adhering of the adapter of the inner container to the head of the outer tube.

25. The method of manufacturing, in accordance with claim 19, wherein the union of the outer tube to the inner container is performed so that the longitudinal axes are arranged substantially parallel and presenting a minimum tolerance, preferably of around tenths of a millimetre and more preferably of around hundredths of a millimetre, so that the outer tube and the inner container are substantially coaxial.

26. The method of manufacturing, in accordance with claim 19, comprising an additional stage for widening the skirt of the inner container by means of plastic deformation, so that both skirts come into contact in an area close to the distal ends.

27. The method of manufacturing, in accordance with claim 26, further comprising a step of making one or several union points in an area close to the distal ends between the walls of the outer tube.

28. The method of manufacturing, in accordance with claim 19, wherein the inner container is made out of a metal-plastic multi-layer complex comprising aluminium.

29. The method of manufacturing, in accordance with claim 19, wherein the inner container is made out of a multi-layer complex comprising a barrier layer, or is made out of a single-layer film, or is made out of a film comprising an inorganic barrier material.

* * * * *